United States Patent [19]

Thelen

[11] 3,960,341

[45] June 1, 1976

[54] SPOOL CORE FOR THE WET TREATMENT OF THREADS AND YARNS

[75] Inventor: Adam Thelen, Laurensberg, Germany

[73] Assignee: Plastic-Fabrik Elbenia GmbH & Co., Inc., Pontsheide, Germany

[22] Filed: Oct. 17, 1974

[21] Appl. No.: 515,441

[30] Foreign Application Priority Data

Dec. 1, 1973 Germany ..... 2360042

[52] U.S. Cl. ..... 242/118.1; 8/155; 68/198

[51] Int. Cl.[2] ..... B65H 75/20

[58] Field of Search ..... 242/118.1, 125.1, 172; 68/198; 8/154, 155

[56] References Cited

UNITED STATES PATENTS

| | | | |
|---|---|---|---|
| 2,081,331 | 5/1937 | Hathaway | 242/125.1 |
| 2,243,101 | 5/1941 | Kinsella | 242/125.1 |
| 2,565,729 | 8/1951 | Jackson | 68/198 |
| 3,647,156 | 3/1972 | Henning | 242/118.1 |

FOREIGN PATENTS OR APPLICATIONS

| | | | |
|---|---|---|---|
| 555,214 | 3/1957 | Belgium | 242/118.1 |

*Primary Examiner*—Leonard D. Christian
*Attorney, Agent, or Firm*—Bacon & Thomas

[57] ABSTRACT

A spool core for the wet treatment, especially the dyeing of thread or yarn spools, having a central shell consisting of a honeycomb-type network of intersecting ribs of triangular cross section and a head collar and foot collar adjoining said shell, the collar having additional flow channels and a knurled surface for improved thread positioning and wetting during treatment.

4 Claims, 6 Drawing Figures

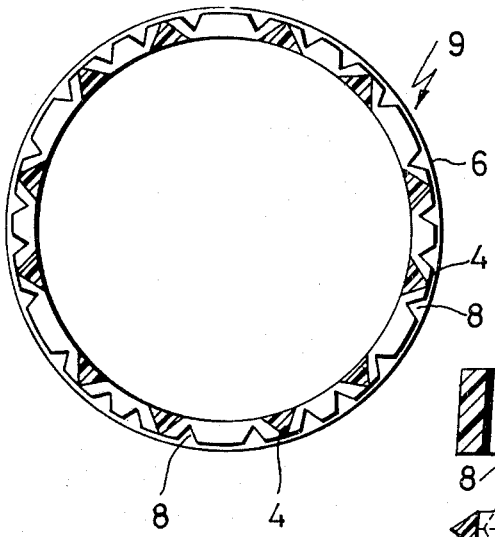
FIG. 2
FIG. 4
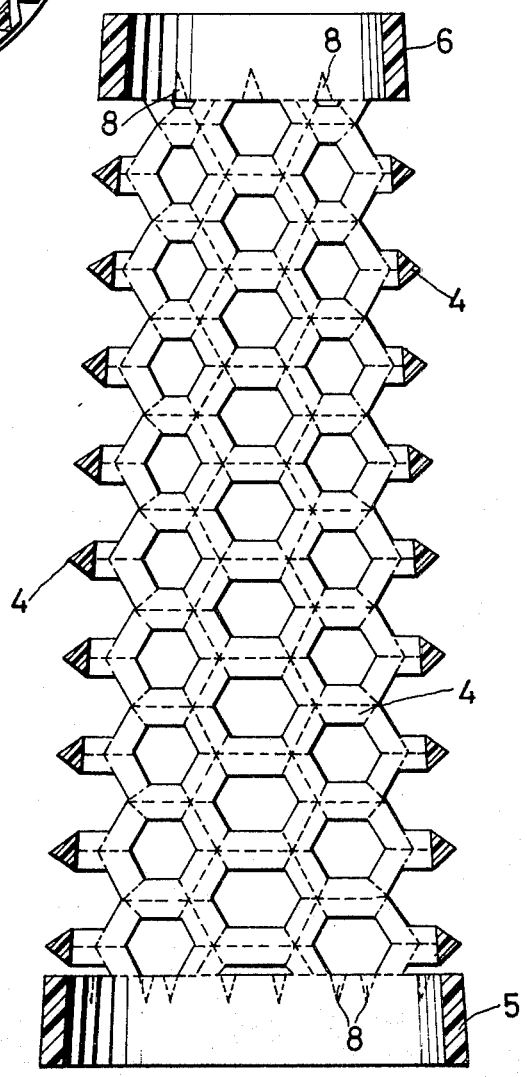

SPOOL CORE FOR THE WET TREATMENT OF THREADS AND YARNS

BACKGROUND OF THE INVENTION

1. Field of the Invention

The present invention relates to spool cores for the wet treatment of threads and yarns, and in particular to perforated spool cores of thermoplastic or thermosetting plastic material, suitable for wet treating spun or twined yarns, especially for the dyeing of yarn spools.

2. Description of the Prior Art

Synthetic threads and yarns are mostly dyed on cross spools wound onto cylindrical or tapered cores of plastic material. Of greatest importance in connection with the dyeing of such cross spools is the uniformity of color penetration, or color uniformity. In practice, this requirement is often very difficult or impossible to satisfy, color uniformity problems arising especially in the end zones of the spools, both at the foot end and at the head end of the spool core. This happens especially then, when the material is spooled too far beyond the perforated surface portion of the core in the direction of the core foot or core head, with the resultant creation of border zones on the spools which are being compressed against the spacer discs positioned between adjacent spools on the dyeing spindles. In such a situation, it often happens that the dye penetration is inadequate and that the desired color uniformity is not achieved.

SUMMARY OF THE INVENTION

Underlying the present invention is the objective of overcoming the earlier-mentioned problems encountered in connection with dye penetration in the spool end zones, by devising a spool core which is especially suited for the wet treatment of threads and yarns and which assures improved uniformity of color penetration throughout the spool on the core, especially by improving the color penetration in the spool end zones.

In order to attain the above objective, the present invention suggests a novel spool core in which the hollow shell of the core is constituted by a honeycomb-type, perforated wall, the perforations being in the form of hexagonal outwardly tapering cells openings.

This novel wall structure suggested by the invention greatly improves the permeability of the core shell to the dyeing liquor, meaning that the latter is provided with large flow channels through which the liquor can penetrate into the spool over virtually the entire supporting surface, rather than through only a number of localized pores or apertures. The shell wall thus consists only of a network of interconnected ribs forming a honey-comb-type structure. The resultant intensified dye circulation through the spool body has the effect of producing an improved color penetration of the yarn. Not only is the contact area between the threads and the core shell reduced as a result of the hexagonal perforations in the latter, but it is further reduced to an absolute minimum, because of the outwardly tapering profile of the constituent ribs of the honeycomb structure.

In the preferred embodiment of the invention, the aforementioned constituent ribs of the honeycomb structure are triangular in cross section, having a flat base on the inner side of the shell wall and tapering toward a crest on which they carry the innermost thread layer. This configuration not only provides an optimal exposure of the inner thread layers to the dye liquor, it also offers advantages in connection with the manufacture of the core body as an injection-molded article.

The preferred embodiment of the invention further features a series of axial flow channels arranged in at least one of the upper and lower collar surfaces adjoining the perforated shell portion of the core at its upper and/or lower extremity. These flow channels are preferably so oriented that they taper axially so as to open toward the perforated shell wall and radially inwardly, thereby opening toward the interior of the spool core. These flow channels are preferably likewise triangular in cross section, thereby simplifying tooling problems in manufacture.

The aforementioned flow channels in the non-perforated collar portions of the spool core now assure that, when some layers of yarn have been spooled onto this portion of the core, either at its bottom end or at its foot end, these yarn layers will likewise receive adequate dye penetration through the flow channels that reach underneath these yarn layers.

In order to further improve the penetration of these critical yarn layers, the invention further suggests to provide on the outer surface of at least one collar portion of the spool core a special raised, knurl-type surface structure, the ridges of the knurl-type structure preferably tapering away near the point and the lateral edges of the aforementioned flow channels.

The preferred embodiment of the invention further features a series of surface protrusions on the rib structure of the shell core itself, especially on those rib portions that are located near the core foot and core head and which extend in a vertical direction, i.e. which are oriented axially. These surface protrusions, or serrations, produce an improved hold between the core and the first thread layers during the start of a spooling operation. This characteristic is of considerable importance for the exact positioning of the innermost thread layers, because from it depends the uniformity of color penetration in these layers and the adequacy or inadequacy of the dyed yarn spool for the intended productive use. This improved hold between the inner yarn layers and the rib portions adjacent the collar surfaces at the foot and head of the spool core is preferably obtained by providing tiny beads or knobs which protrude from the outer rim of the rib portions.

BRIEF DESCRIPTION OF THE DRAWINGS

Further special features and advantages of the invention will become apparent from the description following below, when taken together with the accompanying drawings, which illustrate, by way of example, a preferred embodiment of the invention represented in the various figures as follows:

FIG. 2 is a transverse cross section through the spool core of FIG. 1, taken along line II—II thereof;

FIG. 4 shows the spool core of FIG. 1 in a longitudinal cross section taken along line IV—IV thereof;

DESCRIPTION OF THE PREFERRED EMBODIMENT

Figure 1:
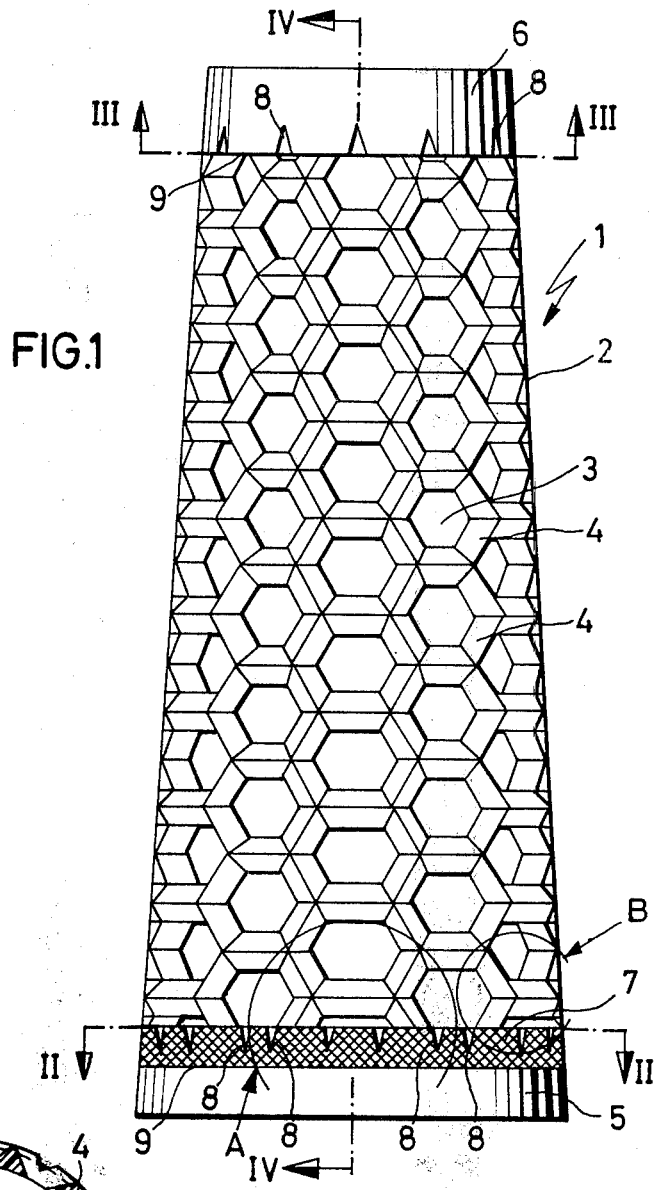
FIG. 1 shows in an elevational view a spool core embodying the invention.
Figure 3:
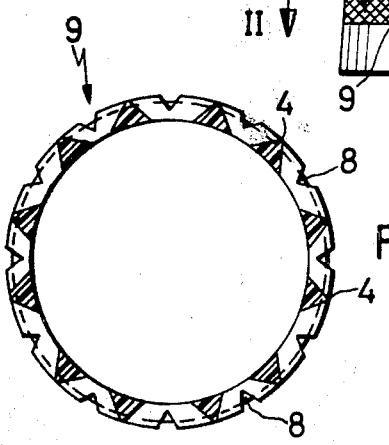
FIG. 3 is a similar cross section through the spool core of FIG. 1, taken along line III—III thereof.

Referring to FIG. 1, there can be seen a spool core 1 embodying the present invention. This spool core is preferably injection-molded from thermoplastic or thermosetting plastic material. The embodiment shown features a core shape that is slightly tapered, but the invention could, of course, also be embodied in a spool core of cylindrical shape.

The major length portion of the spool core is constituted by a perforated shell 2, the wall of the shell being in the form of a honeycomb-type configuration of short ribs 4 surrounding generally hexagonal cell openings 3. The ribs 4, intersecting each other in a honeycomb pattern, have a generally triangular cross section, the base of the preferably isosceles or regular triangle facing radially inwardly to provide a supporting surface for the core, while the crest of the triangle constitutes the outer diameter of the shell 2. The cell openings 3 defined by these triangular ribs thus taper outwardly so that, at the supporting diameter of the spool core shell, the remaining supporting surface for the threads is minimized, the threads being carried only by the top ridges of the ribs 4.

The spool core of the invention further features a bottom collar 5 and a head collar 6 adjoining the shell 2 on opposite ends. These two collars continue in outline the regular taper shape of the shell 2, but are not perforated like the latter. However, each collar preferably has arranged near its line of junction 9 with the shell 2 a series of notches 8, the latter constituting flow channels leading from the collar to the nearest cell opening 3 of the shell 2. Due to the tapered shape of the spool core 1, which necessitates larger cell openings 3 near the foot of the spool core than near its head, there are preferably provided two such notches 8 per cell opening at the bottom of the core and only one notch per cell opening at its top.

As can be seen in FIG. 1, the bottom collar 5 is further provided with a knurled, or otherwise structured surface portion 7. The head collar 6 may be provided with a similar knurled surface portion, if desired. The purpose of this structured surface is to improve the hold of the inner yarn layers on the spool core during startup of the spooling operation.

Figure 5:
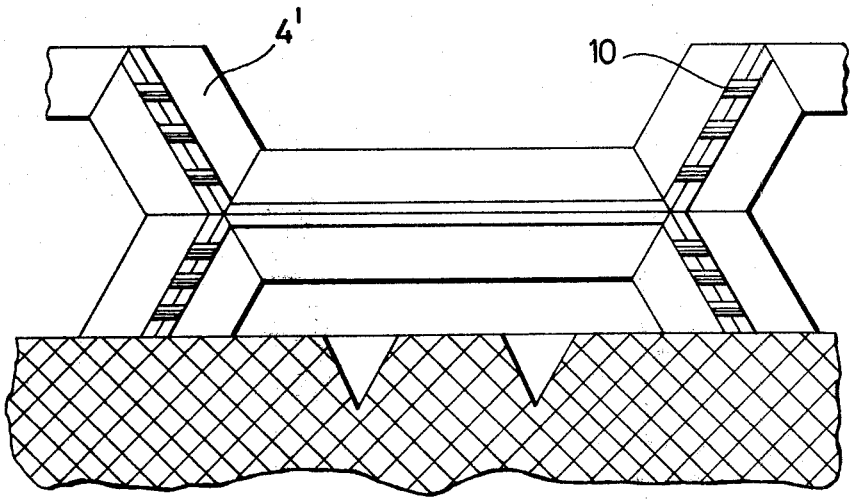
FIG. 5 shows, in greatly enlarged detail, a portion of FIG. 1 indicated by circle A.
Figure 6:
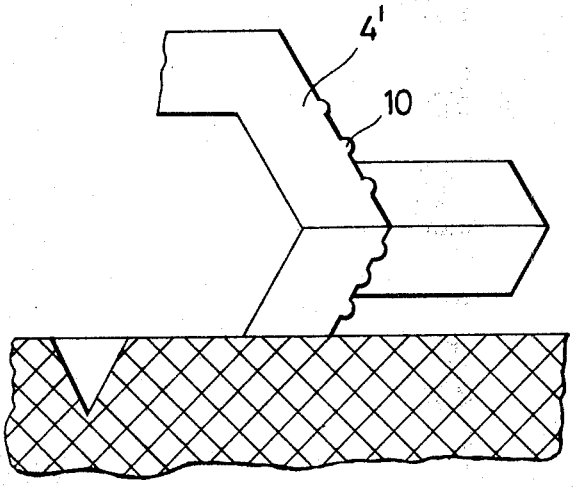
FIG. 6 shows a similarly greatly enlarged portion of FIG. 1 indicated by circle B.

In the enlarged representations of FIGS. 5 and 6 can further be seen additional surface features which are provided on the vertically oriented ribs 4' adjacent the bottom collar 5. As can be seen in FIG. 6, the ridges of these ribs 4' have spaced protrusions or knobs 10. These knobs 10 are likewise provided for improving the hold of the inner yarn layers on and near the foot of the spool core. Instead of the suggested protrusions, there may, of course, be provided suitable peripheral notches or depressions in the ridge of these ribs 4'. Similarly structured ribs may also be provided adjacent the head collar 6 of the core.

It should be understood, of course, that the foregoing disclosure describes only a preferred embodiment of the invention and that it is intended to cover all changes and modifications of this example of the invention which fall within the scope of the appended claims.

I claim:

1. A spool core of unitary construction, manufactured, for example, from injection-molded thermoplastic or thermosetting synthetic material, and adapted for the wet treatment, especially the dyeing, of thread or yarn spools, the spool core comprising:

a hollow tubular elongated shell constituting a major central length portion of the spool core;

a foot collar and a head collar adjoining said shell on both axial ends and constituting respective upper and lower axial end portions of the spool core;

a series of radial perforations or cell openings extending through the wall of said shell in a honeycomb pattern so as to reduce the remaining intermediate shell wall portions to a series of intersecting ribs, the intersecting ribs of the spool core shell having a generally triangular cross section, the triangle of said cross section having its base oriented to face radially inwardly, so that its tip faces outwardly, thereby defining the outer diameter of the shell with a honeycomb pattern of narrow ridges; said cell openings widening radially outwardly toward the outer diameter of the spool core shell; and on at least its axially extending constituent ribs near a collar, means for axially positioning the innermost yarn layers wound thereonto.

2. A spool core as defined in claim 1, wherein said yarn layer positioning means is in the form of knob-like protrusions or serrations on the ridges of said constituent ribs.

3. A spool core of unitary construction, manufactured, for example, from injection-molded thermoplastic or thermosetting synthetic material, and adapted for the wet treatment, especially the dyeing, of thread or yarn spools, the spool core comprising:

a hollow tubular elongated shell constituting a major central length portion of the spool core;

a foot collar and a head collar adjoining said shell on both axial ends and constituting respective upper and lower axial end portions of the spool core, at least one of said two collars includes a series of flow channels in the form of grooves in at least that portion of its outer surface which is nearest the spool core shell; and a series of radial perforations or cell openings extending through the wall of said shell in a honeycomb pattern so as to reduce the remaining intermediate shell wall portions to a series of intersecting ribs; said cell openings widening radially outwardly toward the outer diameter of the spool core shell.

4. A spool core as defined in claim 3, wherein said flow channels are generally axially oriented grooves having a tapering depth that increases toward the shell and a generally triangular cross section which opens in a taper toward an adjacent cell opening of the shell.

* * * * *